US005415890A

United States Patent [19]

Kloiber et al.

[11] Patent Number: 5,415,890

[45] Date of Patent: May 16, 1995

[54] MODULAR APPARATUS AND METHOD FOR SURFACE TREATMENT OF PARTS WITH LIQUID BATHS

[75] Inventors: Allan J. Kloiber, Marshall Township, Allegheny County; Gary G. Bubien, Center; Gerald S. Osmanski, Brighton Township, Beaver County, all of Pa.

[73] Assignee: Eaton Corporation, Cleveland, Ohio

[21] Appl. No.: 176,407

[22] Filed: Jan. 3, 1994

[51] Int. Cl.[6] ..... B05D 3/12; B05C 3/08; B08B 1/02; C25D 17/22

[52] U.S. Cl. ..... 427/242; 204/198; 118/417; 118/423; 134/84

[58] Field of Search ..... 118/423, 417; 204/198; 427/242; 134/84

[56] References Cited

U.S. PATENT DOCUMENTS

| | | | |
|---|---|---|---|
| Re. 30,977 | 6/1982 | Zecher | 51/422 |
| 3,853,094 | 12/1974 | Christini et al. | 118/417 |
| 4,115,960 | 9/1978 | Zecher | 51/422 |
| 4,399,828 | 8/1983 | Kontos | 118/418 X |
| 5,114,751 | 5/1992 | Ahmed et al. | 118/417 X |

*Primary Examiner*—Donald R. Valentine
*Attorney, Agent, or Firm*—Martin J. Moran

[57] ABSTRACT

A modular parts surface treatment system includes a number of modular units each having integral conveying means for transporting the parts through the unit and delivering them to the next unit. The system includes a single modular cleaning unit, preferably for dry, mechanical cleaning of the parts. The modular cleaning unit reciprocates along a set of tracks to deliver cleaned parts to each of several side-by-side modular treatment units which tumble the parts in a bath of treatment solution and then drain them before discharging them onto the conveyor of a modular transfer unit. The modular transfer unit delivers the parts to a modular rinse unit having an inclined conveyor submerged at one end in a tank of rinse water. This conveyor transports the parts through the rinse water and lifts them above the rinse water for draining. If needed, the parts may be passed through a second modular rinse unit, or through a modular additional surface treatment unit, which may be similar to a modular rinse unit or to the modular treatment unit, and then through a second modular rinse unit. Finally, the parts are dried in a spin dryer or dry heated by air on an in-line conveyor unit.

21 Claims, 4 Drawing Sheets

MODULAR APPARATUS AND METHOD FOR SURFACE TREATMENT OF PARTS WITH LIQUID BATHS

Cross-Reference to Related Application: U.S. patent application Ser. No. 08/134,315, filed on Oct. 8, 1993 in the name of Robert F. Zecher and entitled "Method and Apparatus for the Surface Treatment of Parts."

BACKGROUND OF THE INVENTION

FIELD OF THE INVENTION

This invention is directed to an apparatus and method for surface treatment of parts with liquid baths such as electroplating, electroless plating and coating, and more particularly, to a modular system having a number of units through which the parts are sequentially passed by integral conveying members. In addition, dry methods of cleaning are preferably used to clean the pans preparatory to plating or coating in place of the traditional acid bath cleaning and attendant rinsing.

BACKGROUND OF INFORMATION

Current practice for electroplating and electroless plating of small parts involves the use of a large number of tanks in which the pans are sequentially immersed. Typically, these tanks include a wet cleaning stage with rinses followed by an acid bath for removing surface oxides. Several additional stages of rinsing are required prior to plating which is also followed by several rinsing baths. Often, a post-plating process such as chromating is performed on the plated parts.

The parts are placed in large perforated barrels which are transported by a hoist, typically an overhead hoist, from tank to tank. Economics dictate that the barrels cannot be drained completely before transfer so that invariably there is drag out and carry over of solution from one tank to another, and therefore, contamination of the down stream tanks. This is a major reason why several rinse tanks are required after cleaning, acid etching and plating. Regeneration of the various baths and waste treatment of the large volume of spent liquids produced by the process require additional permanent equipment which adds to the cost of the system. Although the tanks (as many as 12 to 18) are placed side by side in a straight line under the overhead hoist, usually there is only one operator, stationed at the beginning of the line. Therefore, the overhead hoist must carry the dripping barrels back over most of the tanks for unloading. This adds to drag out and contamination of the various tanks.

Another aspect of the current plating systems is that the plating step takes longer than the other steps and varies in duration dependent upon the desired thickness of the coating. Typically, the plating tank will be larger than the other tanks to accommodate several barrels at a time, thereby increasing residence time in the plating tank without slowing down the entire line. Still, the barrels are transported in a straight line by the overhead hoist which leads to drag out and contamination of the various tanks.

The current practice of using an overhead hoist to transport the barrels between tanks requires that the tanks be open which results in evaporation including the evaporation of the noxious plating solutions.

Typically, the present plating system requires several hundred square fee to accommodate the numerous tanks and supporting equipment, and of course, requires support for the overhead hoist.

There is a need therefore for an improved plating process and apparatus for carrying out that process.

There is also a need for such an improved apparatus and method which does not require the use of barrels or hoists for transferring parts through the process.

There is also a need for such an improved apparatus and method which minimizes the space required.

There is an associated need for reducing the number of tanks required.

There is a related need for reducing the carry over from one tank to the next which results in contamination of the baths.

There is a related urgent need to reduce waste treatment required and the necessity for frequent regeneration of the baths.

There is also a need for such an apparatus and method in which the plating baths can be covered to minimize release of noxious fumes.

Another important need is for a flexible system which can be easily configured for different applications.

SUMMARY OF THE INVENTION

These needs and others are satisfied by the invention which is directed to an improved method of surface treatment of parts with liquid baths, such as plating or coating, which utilizes a combination of modular units selected for the particular application. The modular units incorporate separate conveying means for transporting the parts through the unit to the next modular unit, thereby eliminating the need for the barrels and overhead hoist. Several types of modular units are assembled to perform the plating or coating process. Cleaning of the parts prior to plating or coating is performed in a modular cleaning unit which uses mechanical means, preferably dry blasting.

Plating or coating is carried out in modular treatment units each having a tank containing the plating solution. The conveying means in the treatment unit receives the parts from the modular cleaning unit, tumbles them in the treatment solution and then discharges the treatment parts. Where the required residence time in the treatment unit is longer than in the other units, a plurality of treatment units are placed side by side with the parts moving in parallel paths though the aligned treatment units. The modular cleaning unit is preferably mounted on tracks so that it can be sequentially aligned to transfer parts to each of the modular treatment units. Alternatively, conveyor means can be used to distribute cleaned parts to the plating units. As a further alternative, plural clearing units can be used.

The parts discharged from the plurality of treatment units are gathered by modular transfer means, preferably in the form of a modular transfer unit having a conveyor positioned transverse to and intersecting all of the parallel paths along which parts are discharged from the treatment modular units.

The parts are drained of residual treatment solution while on the transverse conveyor which then deposits them in a modular rinse unit. The modular rinse unit includes a rinse tank containing rinse water. The parts fall though the rinse water onto a receiving end section of conveyor means submerged in the rinse water. A discharge end section of this convey means rises above the rinse water so that the residual rinse water on the pans drains back into the rinse tank before the parts are discharged. If desired, a second modular rinse unit can be positioned to receive the parts from the first rinse unit and perform a second rinse operation in a similar manner. Additional surface treatment, such as chromating, can be carried out in a modular unit such as the modular rinse unit, or where tumbling of the parts is required, a modular treatment unit. This additional treatment can be followed by rinsing in another modular rinse unit.

Preferably, a blower means is provided in the modular transfer unit adjacent the conveyor means to strip the residual treatment solution from the parts. Similarly, blower means can be provided adjacent the discharge end section of the conveyor means in the rinse units for stripping rinse water from the parts. Also preferably, the parts are contacted with additional rinse water in the modular rinse unit after they have been lifted out of the rinse water by the conveying means and before they pass the blower means. A modular drying unit can be provided to completely dry the raised pans.

In accordance with the present invention, only one modular cleaning unit, one or more modular treatment units, a transfer unit, and one or two modular rinse units are required in place of the 12 to 18 tanks required in existing plating systems. Thus, the apparatus of the present invention takes up much less space. It also greatly reduces the amount of bath that must be regenerated and the quantity of liquid that requires waste treatment. At the same time, it eliminates the-need for the barrels and the overhead hoists. In addition to reduced system size, the modular units can be aligned so that the parts are discharged in proximity to the modular cleaning unit so that loading and unloading can be easily handled by a single operator without the problems of carryover from one unit to the next as is the case with the existing apparatus. All in all, the present invention provides a cleaner, more compact, flexible apparatus and method which requires less treatment of liquids.

BRIEF DESCRIPTION OF THE DRAWINGS

A full understanding of the invention can be gained from the following description of the preferred embodiments when read in conjunction with the accompanying drawing in which.

DESCRIPTION OF THE PREFERRED EMBODIMENT

The invention will be described as applied to a system for electroplating parts. It will be readily apparent to those skilled in the art, that the invention has application to other types of surface treatment of parts using various liquid baths. These include electroless plating of parts and the application of various coatings. For instance, the invention can be used in phosphatizing parts.

Figure 1:
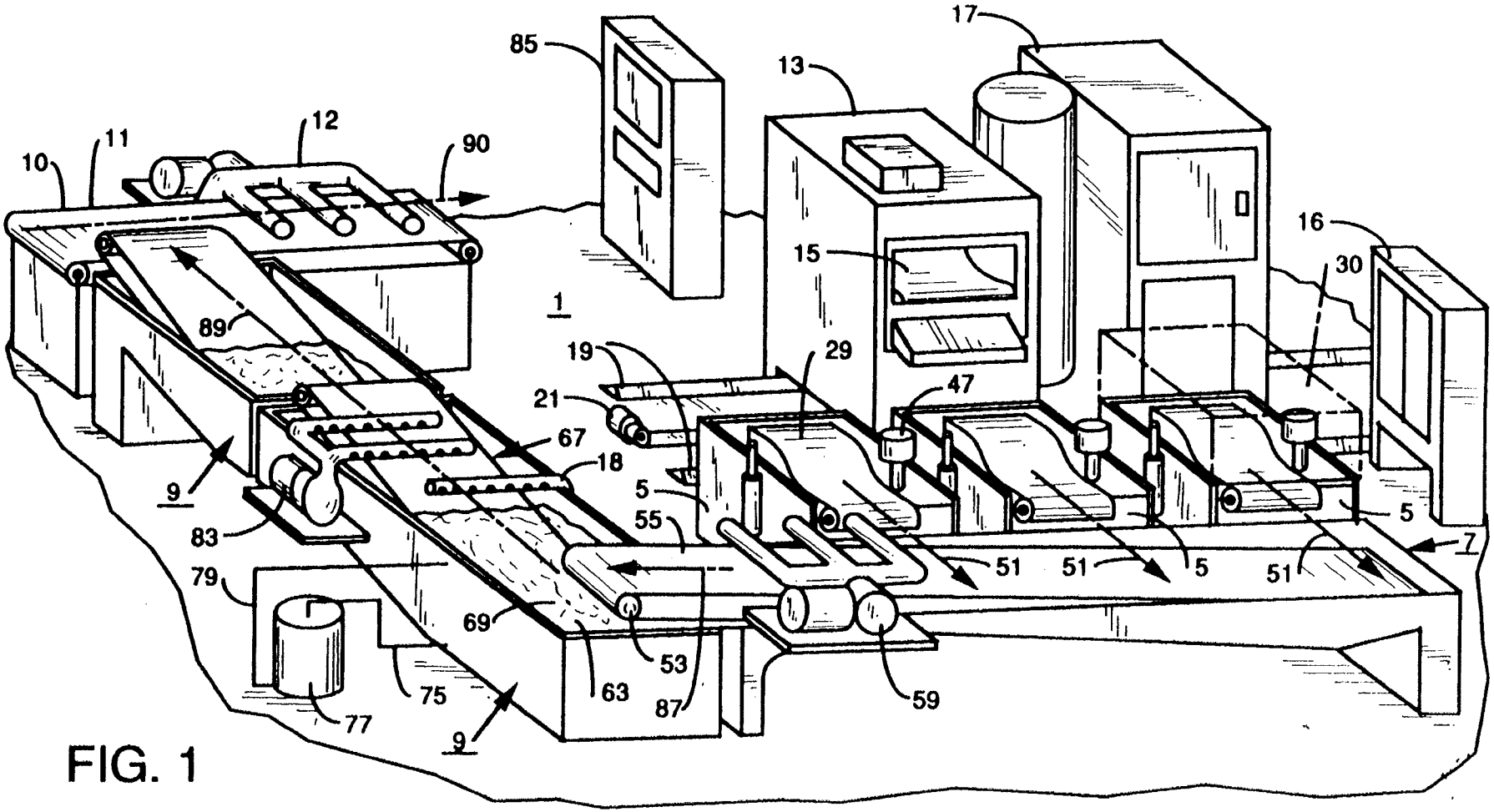
FIG. 1 is an isometric drawing of an electroplating line in accordance with the invention.

FIG. 1 illustrates a first configuration of a plating line 1 in accordance with the invention. Plating line 1 includes a number of modular units such as 3, 5, 7, 9 and 11 which perform the various steps of the process for plating small parts. These modular units include a modular cleaning unit 3. The process in accordance with the invention uses mechanical cleaning rather than acid etching as is now conventional. In particular, the modular mechanical cleaning unit 3 includes a mechanical cleaning unit 13. This mechanical cleaning unit 13 is preferably of the type described in U.S. Pat. No. 4,151,930 now U.S. Pat. No. Re. 30,997 which are hereby incorporated by reference. This air blast unit includes a conveyor 15 which can be tilted so that parts carried on an upper run of the conveyor are lifted upward and tumble backward continuously. This tumbling action exposes the parts to the air blast which removes the oxides and other contamination. The air blast contains media, such as plastic grit, or glass beads, for example, which assist in cleaning the parts. The air containing the removed oxides and contaminates and the media is circulated through a filter and media reclaim unit 17 adjacent to the air blast unit 15. The modular cleaning unit 3 is mounted for reciprocal movement along a pair of tracks 19 by a drive mechanism shown symbolically at 21.

The modular cleaning unit 3 cleans the parts and transfers them by means of the integral conveyor 15 to one of several modular plating units 5. Alternatively, separate conveyor means can be used to transfer parts from a stationary modular cleaning unit 3 to the plurality of modular plating units 5. While a single modular plating unit 5 could be used, it is preferable to have several such units since the plating step requires more time than the other steps of the process. The modular plating units 5 utilize features of the tumbling mechanisms described in U.S. Pat. No. 4,115,960 and U.S. Pat. No. Re. 30,977 modified for the plating process. Suitable modifications to the machines are described in the related application Ser. No. 08/134,315, filed on Oct. 3, 1993 in the name of Robert F. Zecher and entitled "Method and Apparatus for Surface Treatment of Parts." The modular plating units 5 are arranged side by side alongside the tracks 19. A rectifier unit 16 provides the plating current for the units 5 for electroplating.

Figure 2:
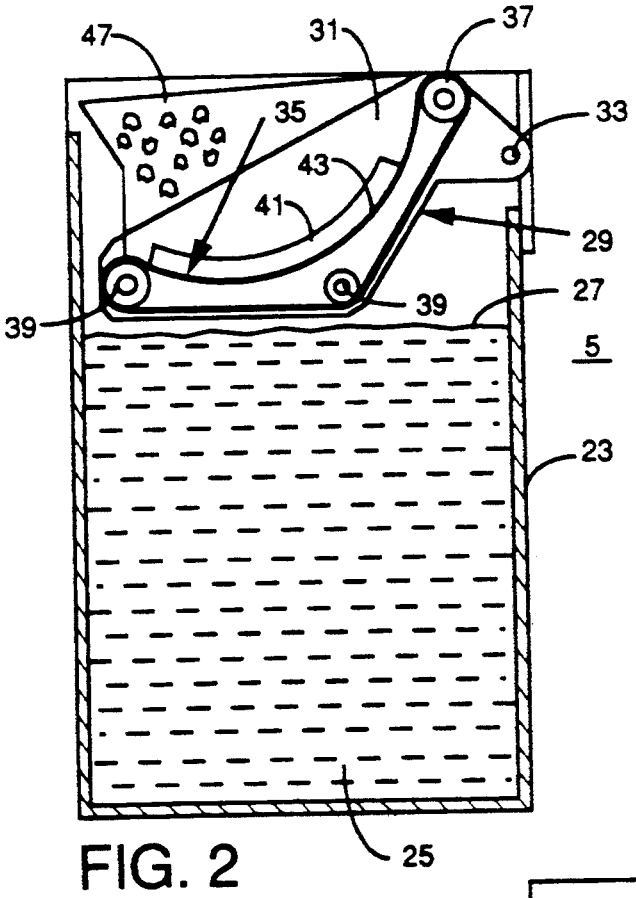
FIG. 2 is a vertical section schematically illustrating a modular plating unit with parts shown in a first position for loading and for draining parts after plating.
Figure 3:
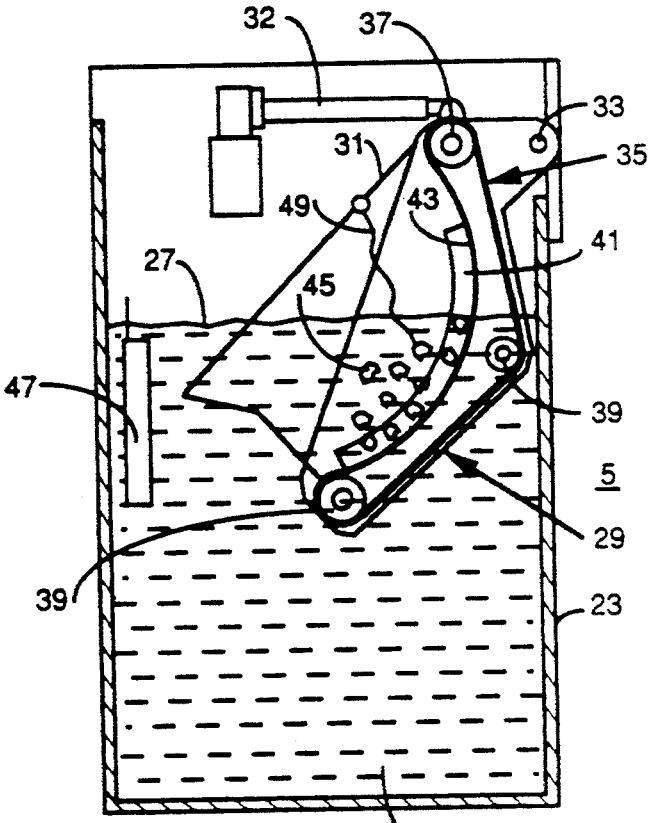
FIG. 3 is a view similar to FIG. 2 showing a modular plating unit configured for the plating operation.
Figure 4:
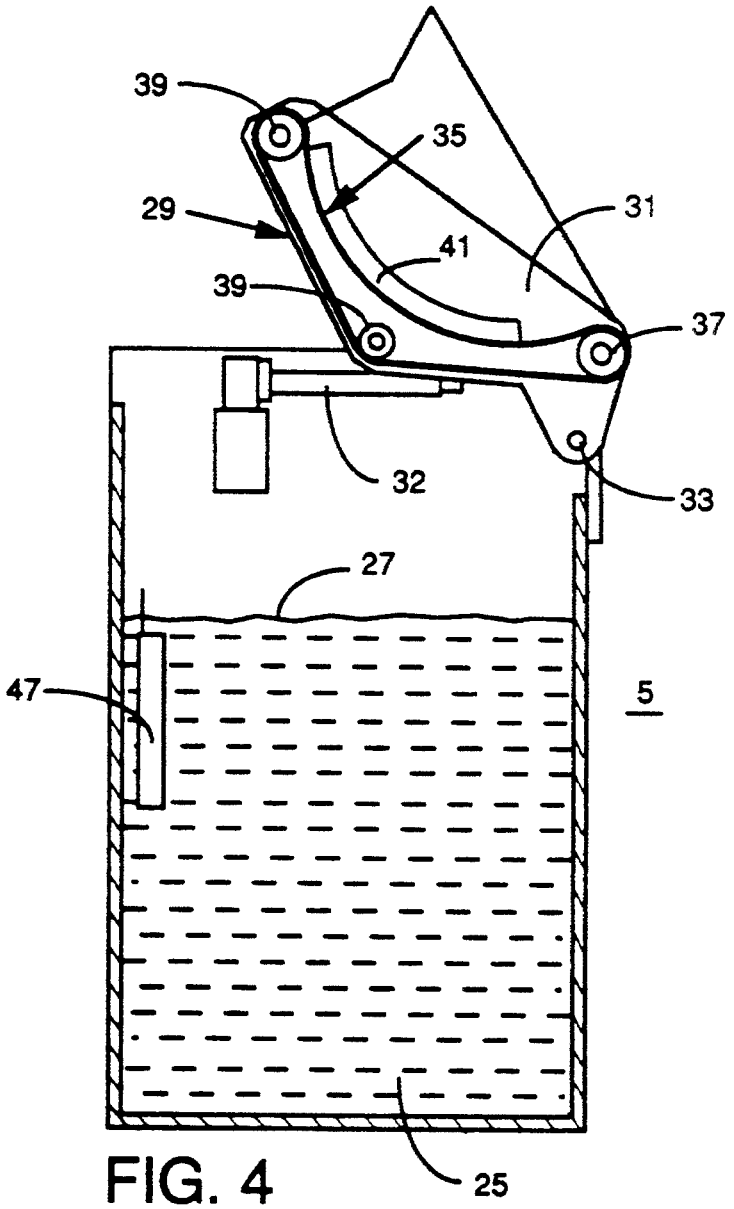
FIG. 4 is a view similar to FIGS. 2 and 3 showing a modular plating unit configured to discharge plated parts.

FIGS. 2–4 illustrate the pertinent features of the modular plating units 5. These modular plating units 5 include a plating tank 23 containing a plating solution to a level 27. A conveyor device 29 comprises a frame 31 pivotally mounted at one end for rotation by an actuator 32 (see FIG. 3) about a pivot axis 33 located above the level 27 of the plating solution. A conveyor belt 35 is supported by a drive roller 37 and idler rollers 39 mounted on the frame 31. Edge guides 41 guide the conveyor belt along a concave upper run 43. The driver roller 37 rotates the conveyor belt so that the upper run 43 travels in the direction of the arrow A. The conveyor belt 35 is porus but with a mesh small enough to support the parts 45 to be plated.

The conveyor device 29 is positioned as shown in FIG. 2 for receiving parts discharged by the modular cleaning unit 3. Perforated sides 47 maintain the parts on the conveyor belt 35. Once the conveyor device 29 is loaded, it is pivoted to the plating position shown in FIG. 3 in which the lower portion of the conveyor device is immersed in the plating solution 25. In the plating position, the upper run 43 of the conveyor belt has a very steep rise so that the parts 45 are lifted until the angle of repose is exceeded and they fall backward and are thus continuously tumbled. As shown in FIG. 3, an anode 47 is immersed in the plating tank 23 and cathode danglers 49 contact the tumbling pans 45 to complete the circuit for the plating current.

The conveyor device 29 remains in the plating position in FIG. 3 until the desired plating thickness is achieved. The conveyor device 29 is then raised to the load/drain position shown in FIG. 2 so that the plating solution can drain through the porus conveyor belt 35 and back into the plating tank 23. When the parts are sufficiently drained, the conveyor device 29 is raised to the discharge position shown in FIG. 4 for transfer of the plated pans to the next modular unit. The modular plating units 3 may be provided with a cover 30 to reduce evaporation of the noxious plating solution.

Returning to FIG. 1, the modular cleaning unit 3 is sequentially positioned to discharge clean parts into each of the modular plating units 5. The parts move through the side by side modular plating units 5 along parallel paths 51.

The conveyor devices 25 of the modular plating units 5 deposit the plated parts on a conveyor 53 of the modular transfer unit 7 which extends transversely to the parallel paths 51. The conveyor 53 has a porus belt 55 through which residual plating solution can drain into a shallow tank 57. Preferably, a blower 59 is mounted above the belt 55 to strip additional residual plating solution from the parts.

Figure 5:
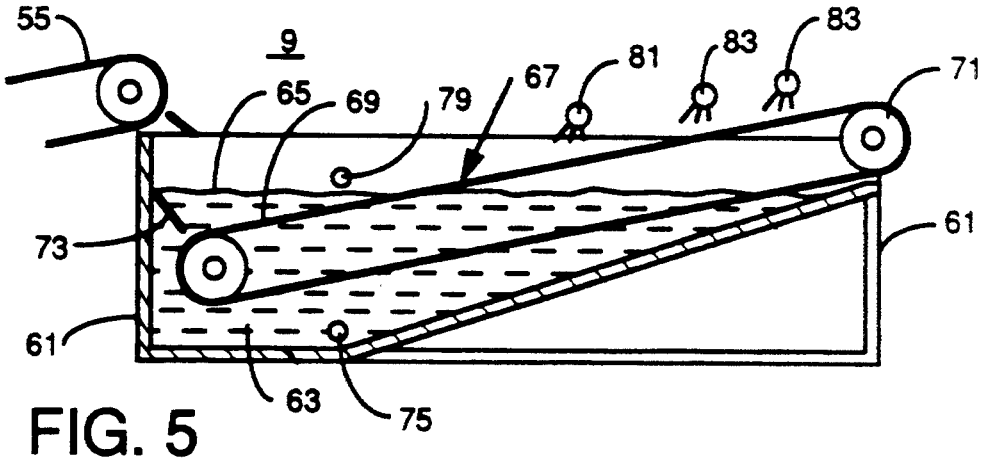
FIG. 5 is a vertical section through a modular rinse unit which forms part of the plating line in accordance with the invention.

The conveyor 53 discharges parts stripped of the plating solution into the modular rinse unit 9. As can be seen from FIGS. 1 and 5, the modular rinse unit 9 has a rinse water tank 61 containing rinse water 63 to a level 65. A conveyor, 67 has a receiving end section 69 immersed in the rinse water 63. A discharge end section 71 of the conveyor 67 rises above the rinse water level 65. Pans discharged from the conveyor 53 of the modular transfer unit 7 fall through the rinse water 63 and are guided onto the receiving end section 69 of the conveyor 67 by deflector 73. The parts are carded through the rinse water 63 by the conveyor 67 and are then drained of rinse water as the conveyor lifts them above the water level 65. The rinse water 63 is circulated by drain pipe 75 through a self-contained regeneration unit 77 and returned to the tank 61 through return line 79. The regeneration unit 77 can include a filter and an ion exchange media, a powdered resin or other such known media for removing residual plating ions from the rinse water.

Preferably, the parts are sprayed with rinse water dispensed from a spray bar 81 as they travel upward above the rinse tank. A blower unit 83 strips any remaining rinse water from the parts before they are discharged by the conveyor 67 into a second modular rinse unit 9. The second rinse unit is similar to the rinse unit just described in detail and may or may not include the spray bar 81 and/or the blower 83. In many plating operations, one modular rinse unit 9 will be sufficient as the parts are well drained in the plating units 5, and most of the residual plating solution is removed by the modular transfer unit 7. Thus, there is very little carry over to overload the modular rinse unit 9 so that one and possibly two such modular rinse units are sufficient. This is a marked improvement over the prior art plating lines which require three or four rinses, due in large part to the carry over from one tank to another.

Preferably, the parts discharged from the last modular rinse unit 9 are dried in a modular dryer unit 11. This modular dryer unit 11 includes a conveyor 10 oriented generally transverse to the conveyor of the last rinse unit 9. A blower system 12 directs heated air at the parts to dry them before they are discharged.

The plating system of the invention reduces the number of units required, thereby reducing the area need to accommodate the system. Furthermore, the system can be arranged as shown in FIG. 1 in a very compact arrangement so that a single operator located at a control station 85 can control the whole operation, including loading parts into the air blast unit 13 and retrieving parts from the modular dryer unit 11. The latter is made possible by positioning the units so that the first unit on the line, the modular cleaner unit 3, and the last unit, the modular dryer unit 11, are both located adjacent the control station 85. This is accomplished by changing the direction of the paths of the parts through the processing line. Thus, the transfer conveyor 53 directs the parts in a single down stream path 87 which is transverse to the parallel paths 51 of the parts through the modular plating units 5. The modular rinse units then direct the parts along a path 89 which is generally parallel to but opposite in direction to the parallel paths 51 through the modular plating units. The modular dryer unit 11 then directs the parts along a path 90 generally transverse to the path 89. It will be obvious to those skilled in the art that the modular construction of the plating system of the invention provides a great deal of flexibility and offers the opportunity for assembling a plating line which accommodates the process required and the space available.

Figure 6:
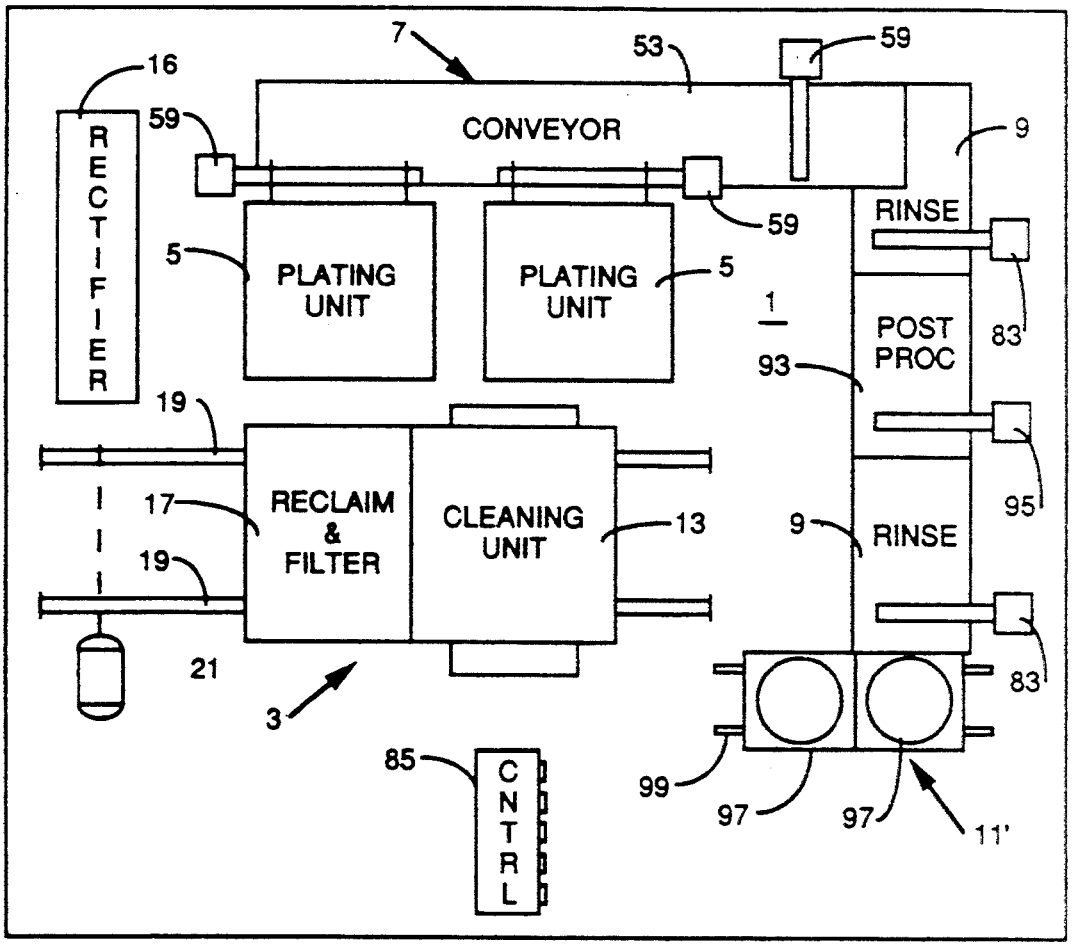
FIG. 6 is a plan view of another configuration of a plating line in accordance with the invention.

The various arrangements possible are too numerous to be fully set forth here. However, FIG. 6 illustrates one possible other arrangement for a plating system 1' in accordance with the invention. As shown, this system 1' includes two modular plating units 5. It also provides additional blower units 59 for stripping plating solution from parts as they are discharged from the modular plating units 5 onto the conveyor 53 of the modular transfer unit 7. The system 1' also includes a modular post-plating treatment unit 93 after the first rinse unit 9 which removes the plating solution. This modular post-plating treatment unit 93 may be a chromating unit which is similar to the rinse unit 9 but contains in tank 95 a chromating solution rather than rinse water through which the parts are conveyed by a conveyor 97. If necessary, the modular post-plating treatment unit 93 can be a unit such as the modular plating unit 5 if tumbling of the parts is required. The modular post-plating treatment unit 93 has a blower 99 adjacent the discharge end to strip residual treatment solution from the parts before they are discharged into a second modular rinse unit 9.

In this processing line 1', the dryer unit 11' comprises two spin dryers 101 mounted on tracks 103 for sequential loading with parts from the last modular rinse unit 9. Again, the modular conveyor unit 11 shown in FIG. 1 could alternatively be used to dry the finished parts.

In addition to reducing the process equipment required and therefore reducing the area required, an important feature of the plating system of the invention is that it reduces the carry over from one tank to another and therefore the quantity of liquid that must be treated and regenerated. This is important not only from an economic standpoint but also for meeting ever more stringent environmental restrictions.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended, and any and all equivalents thereof.

What is claimed:

1. A system for surface treatment of parts with liquid baths, comprising: a plurality of modular units each incorporating separate conveying means for transporting said parts through said modular unit to a next modular unit and having means for specified processing of said parts while in said modular unit, including a plurality of modular treatment units each having a tank adapted to contain a bath of treatment solution, said conveying means of said at least one modular treatment unit being adapted to tumble said parts in said bath of treatment solution before transporting said parts to a next modular unit; said plurality of modular treatment units being placed side by side such that parts are transported along parallel paths through said modular treatment units, said modular units including modular unit means following said modular treatment units for receiving parts discharged from said plurality of modular treatment units along said parallel paths and directing said parts into a single downstream path; each said modular unit means comprising a modular transfer unit having an elongated conveyor positioned transverse to and intersecting all of said parallel paths to receive parts discharged from all of said modular treatment units.

2. The system of claim 1 wherein said single modular transfer unit includes blower means adjacent a discharge end of said elongated conveyor for stripping any residual treatment solution from said parts, and collection means under said elongated conveyor and blower means for accumulating said residual treatment solution.

3. The system of claim 2 wherein said modular units include a modular cleaner unit for cleaning said parts and positioning means selectively positioning said modular cleaner unit for delivering said cleaned parts sequentially to each of said plurality of modular treatment units.

4. The system of claim 3 wherein said positioning means comprises track means transverse to and intersecting projections of said parallel paths through said modular treatment units, and means positioning said modular cleaner unit along said track means for selectively aligning said modular cleaner unit to deliver cleaned parts along each of said parallel paths.

5. The system of claim 4 wherein said modular cleaner unit comprises means mechanically cleaning said parts.

6. The system of claim 1 wherein said modular units include modular unit cleaning means incorporating means for mechanically cleaning said parts and delivering cleaned parts to each of said plurality of modular treatment units.

7. The system of claim 1 wherein said modular units include at least one modular rinse unit comprising a rinse tank adapted to container rinse water and conveyor means having a receiving end section adapted for submersion in said rinse water on which parts are deposited for travel through said rinse water, and a discharge end section adopted for rising above said rinse water and adopted for allowing said rinse water to drain from said parts before said parts are discharged from said modular rinse unit.

8. The system of claim 7 wherein said modular rinse unit further includes blower means adjacent said discharge end section and over said rinse tank for stripping residual solution and rinse water from said parts for return to said rinse tank.

9. The system of claim 7 wherein said modular rinse unit further includes application means adjacent said discharge end section and over said rinse tank for applying rinse water over said parts.

10. The system of claim 9 wherein said modular rinse unit further includes blower means adjacent said discharge end section after said application means for blowing residual rinse water from said parts before discharge from said conveyor means.

11. The system of claim 7 including an additional modular rinse unit comprising a rinse tank adapted to contain additional rinse water, and conveyor means having a receiving end section adapted for submersion in said additional rinse water on which parts discharged from said the first recited modular rinse unit are deposited for travel through said additional rinse water, and a discharge end section adapted for rising above said additional rinse water and adapted for allowing said additional rinse water to drain from said parts which are then discharged.

12. The system of claim 11 including a modular additional treatment unit between said first recited modular rinse unit and said additional modular rinse unit comprising a tank adapted to contain a bath of an additional treatment solution and conveying means for receiving parts discharged from said first recited modular rinse unit, adopted for passing said parts through said additional treatment solution, draining said additional treatment solution from said parts and discharging said parts to said additional modular rinse unit.

13. The system of claim 7 including spin dry means for spin drying parts discharged from said modular rinse unit.

14. Apparatus for plating parts comprising:

a modular mechanical cleaning unit for cleaning said parts and mounted for reciprocal movement along a first path;

a plurality of modular plating units mounted side by side alongside said first path and each having first conveying means transporting parts there through along parallel paths generally transverse to said first path, and a tank adapted to contain plating solution in which said parts are tumbled by said first conveying means;

means aligning said modular mechanical cleaning unit along said first path for selectively transferring parts therefrom to each of said plurality of modular plating units;

a modular transfer unit having second conveying means extending along a second path generally transverse to and intersecting each of said parallel paths for receiving parts discharged from said first conveying means of each of said modular plating units and transporting said parts along said second path; and at least one modular rinse unit comprising a rinse tank adapted to contain rinse water, and third conveying means, extending along a third path generally transverse to said second path and generally parallel to but opposite in direction to said parallel paths, said third conveying means having a receiving end section adapted to submersion in said rinse water on which parts discharged from said second conveying means of said modular transfer unit are deposited for travel through said rinse water, and a discharge end section adapted for rising above said rinse water and adapted for allowing rinse water to drain from said parts into said rinse tank.

15. The apparatus of claim 14 wherein said modular transfer unit includes first blower means adjacent said second conveying means for blowing residual plating solution from said parts.

16. The apparatus of claim 14 wherein said modular rinse unit includes application means adjacent said discharge end section of said third conveying means for applying to said parts rinse water and second blower means adjacent said discharge end section of said third conveying means after said application means for blowing said rinse water from said parts.

17. A method of surface treatment of parts with liquid baths comprising the steps of:

mechanically cleaning said parts;

transferring said parts by first conveyor means to second conveyor means;

immersing said parts on said second conveyor means in a treatment tank containing a bath of treatment solution and tumbling said parts on said second conveyor means in said treatment solution;

transferring said parts out of said treatment tank by said second conveyor means;

rinsing said parts in a rinse tank containing rinse water by transporting said parts through said rinse water on third conveyor means which then raises the parts above the rinse water for draining; and collecting parts discharged from said third conveyor means.

18. The method of claim 17 wherein said step of immersing said parts comprises immersing separate batches of parts for separately selectable intervals in separate treatment tanks containing treatment solution, each treatment tank having second conveyor means, and collecting said batches of parts transferred out of said treatment tanks by said second conveyor means on fourth conveyor means and transferring said parts to said rinse tank using said fourth conveyor means.

19. The method claim 17 including blowing residual treatment solution from said parts before rinsing.

20. The method of claim 17 including applying to said parts additional rinse water after said parts are raised above the rinse water in the rinse tank, collecting applied additional rinse water in said rinse tank, and blowing residual additional rinse water from said parts.

21. The method of claim 17 comprising after said step of rinsing said parts, passing said parts through a bath of an additional treatment solution on fifth conveyor means, draining said parts of said additional treatment solution, rerinsing said parts by transferring said parts from said fifth conveyor means to sixth conveyor means and passing said parts on said sixth conveyor means through an additional rinse tank containing additional rinse water and raising said parts above the additional rinse water for draining.

* * * * *